US011162150B2

(12) United States Patent
Zhao et al.

(10) Patent No.: US 11,162,150 B2
(45) Date of Patent: Nov. 2, 2021

(54) METHOD FOR MANUFACTURING SUPERIOR 13CR TOOL COUPLER

(71) Applicant: BAOSHAN IRON & STEEL CO., LTD., Shanghai (CN)

(72) Inventors: Peng Zhao, Shanghai (CN); Jie Yu, Shanghai (CN); Shaofeng Liu, Shanghai (CN); Chunxia Zhang, Shanghai (CN); Minghua Wang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 124 days.

(21) Appl. No.: 14/784,448

(22) PCT Filed: Oct. 9, 2013

(86) PCT No.: PCT/CN2013/084876
§ 371 (c)(1),
(2) Date: Oct. 14, 2015

(87) PCT Pub. No.: WO2014/169593
PCT Pub. Date: Oct. 23, 2014

(65) Prior Publication Data

US 2016/0068924 A1 Mar. 10, 2016

(30) Foreign Application Priority Data

Apr. 19, 2013 (CN) ..... 201310139112.0

(51) Int. Cl.

| | |
|---|---|
| ***C21D 8/00*** | (2006.01) |
| ***B21K 1/76*** | (2006.01) |
| ***C21D 6/00*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C21D 1/25*** | (2006.01) |
| *C21D 7/13* | (2006.01) |

(52) U.S. Cl.

CPC ..... *C21D 8/005* (2013.01); *B21K 1/76* (2013.01); *C21D 1/25* (2013.01); *C21D 6/004* (2013.01); *C21D 6/005* (2013.01); *C21D 6/008* (2013.01); *C21D 9/0068* (2013.01); *C22C 38/002* (2013.01); *C22C 38/02* (2013.01); *C22C 38/04* (2013.01); *C22C 38/44* (2013.01); *C21D 7/13* (2013.01); *C21D 2211/008* (2013.01)

(58) Field of Classification Search

CPC ..... B21J 5/00; B21K 1/76; C21D 1/25; C21D 6/004; C21D 8/005

See application file for complete search history.

(56) References Cited

U.S. PATENT DOCUMENTS

| | | | | |
|---|---|---|---|---|
| 2002/0164260 | A1* | 11/2002 | Koga | C22C 38/001 420/61 |
| 2005/0269074 | A1 | 12/2005 | Chitwood | |
| 2013/0101425 | A1* | 4/2013 | Arai | F01D 5/28 416/224 |
| 2014/0161658 | A1* | 6/2014 | Wert | C21D 6/004 420/38 |

FOREIGN PATENT DOCUMENTS

| | | | |
|---|---|---|---|
| CN | 101397637 A | * | 4/2009 |
| CN | 101397637 A | | 4/2009 |
| CN | 101275207 B | | 4/2010 |
| CN | 102172626 B | | 7/2012 |
| CN | 102601597 A | * | 7/2012 |
| CN | 102619477 A | | 8/2012 |
| CN | 102851607 A | | 1/2013 |
| CN | 103009026 A | * | 4/2013 |
| JP | 2003105441 A | | 4/2003 |

OTHER PUBLICATIONS

Espacent machine translation of CN-101397637-A, generated Jan. 28, 2019 (Year: 2019).*

Byars, Harry G.. (1999). Corrosion Control in Petroleum Production—TPC Publication 5 (2nd Edition)—4.2.6.1 Ringworm Corrosion. NACE International (Year: 1999).*

PCT International Search Report, PCT/CN2013/084876, dated Jan. 23, 2014, 8 pages.

* cited by examiner

*Primary Examiner* — Anthony M Liang

(74) *Attorney, Agent, or Firm* — Quarles & Brady LLP

(57) ABSTRACT

The present invention discloses a method for manufacturing a superior 13Cr tool coupler, which method comprises the following steps: manufacturing a blank;
forging the blank; heating the forged blank to 600-700° C. for a stress-relief annealing; quenching; and tempering. The present technical solution can produce a superior 13Cr tool coupler which achieves a mechanic feature of 110 ksi.

4 Claims, No Drawings

METHOD FOR MANUFACTURING SUPERIOR 13CR TOOL COUPLER

CROSS-REFERENCE TO RELATED APPLICATIONS

This application represents the national stage entry of PCT International Application No. PCT/CN2013/084876 filed Oct. 9, 2013, which claims priority of Chinese Patent Application No. 201310139112.0 filed Apr. 19, 2013, the disclosures of which are incorporated by reference here in their entirety for all purposes.

FIELD OF THE INVENTION

The present invention relates to a method for manufacturing a coupler, and in particular a method for manufacturing a high alloy coupler.

BACKGROUND ART

Drillrods for use in oil and natural gas exploration are manufactured according to the API SPEC 5DP standards. The structure thereof has an externally threaded drillrod coupler and an internally threaded drillrod coupler which are respectively frictionally butt-welded at the two ends of the drillrod tube body. Drillrods in compliance with the API SPEC 5DP standards are of a low alloy steel material.

With the development of the oil industry, the conditions in which drillrods operate become more and more severe, drillrods of the low alloy steel material as per the API SPEC 5DP standards now fail to fulfill the increasingly harsh requirements of well drilling operation, and there exists an urgent need for a high alloy drillrod. To this end, aluminum alloy drillrods and titanium alloy drillrods appeared on the market. The aluminum alloy drillrods are manufactured as per the ISO 15546 standards. The aluminum alloy drillrod is formed from an aluminum alloy drillrod tube body connected by means of fine threads with an externally threaded coupler made of low alloy steel and an internally threaded coupler made of low alloy steel. The structure of the titanium alloy drillrod is similar to that of the aluminum alloy drillrod.

The utilization of the aluminum alloy drillrod and the titanium alloy drillrod has two major objectives as follows: one is to drill a super deep well by taking the titanium alloy drillrod, and the other is to drill a sulfur-containing well by taking advantage of the resistance property of the aluminum alloy drillrod and the titanium alloy drillrod to stress corrosion by sulfides.

For some $CO_2$-containing gas fields whose stratum is of compact sandstone, in the case of a conventional method of operation which employs a drillrod for drilling a well and an oil tube for completing the well, the yield is only tens of thousands of cubic meters/day; in addition, superior 13Cr high alloy oil tube products must be used in a gas field containing a relatively high level of $CO_2$, resulting in an extremely low yield of production and an extremely high cost, meaning low value in industrial exploration.

If a nitrogen well-drilling process can be employed, the above-mentioned problem can be solved and a high yield of millions of cubic meters of natural gas per day can be achieved. However, when the nitrogen well-drilling process is used, the drillrod cannot be lifted out to exchange into the oil tube for well completion, otherwise the production layer would be contaminated, lowering the yield back to tens of thousands of cubic meters/day. This gives rise to the need of a superior 13Cr high alloy drillrod coupler resistant to $CO_2$ corrosion.

SUMMARY OF THE INVENTION

An object of the present invention is to provide a method for manufacturing a superior 13Cr tool coupler, which method can be used to produce a superior 13Cr tool coupler adaptive to a superior 13Cr drillrod, which drillrod is in turn used in the exploration of a gas field containing a relatively high level of $CO_2$.

According to the above-mentioned object, the present invention proposes a method for manufacturing a superior 13Cr tool coupler, which method comprises the following steps:

(1) manufacturing a blank;

(1) manufacturing a blank;

(2) forging the blank;

(3) heating the forged blank to 600-700° C. for a stress-relief annealing;

(4) quenching; and (5) tempering.

Existing high alloy drillrods, including aluminum alloy drillrods and titanium alloy drillrods, are all formed by connecting steel couplers to an aluminum alloy or titanium alloy tube body by means of fine threads. There are galvanic corrosions between the steel couplers and the aluminum alloy or titanium alloy tube body, easily causing severe corrosions at the steel couplers. The superior 13Cr tool coupler manufactured by the present technical solution is to be used with a superior 13Cr drillrod, and when the coupler is connected to a superior 13Cr tube body, there is no galvanic corrosion and no severe corrosion will occur at the coupler.

In an existing process for manufacturing a tool coupler, the tool coupler is submitted to a normalization treatment after forging, and the temperature of the normalization treatment is generally 800-950° C. This process will result in the formation of a martensitic structure in the superior 13Cr tool coupler, causing difficulties in later steps. However, in the present technical solution, a stress-relief annealing treatment at 600-700° C. is used, so that the structure of the treated superior 13Cr tool coupler is a tempered martensitic structure, facilitating later steps.

In the method for manufacturing a superior 13Cr tool coupler described above, the chemical composition in percentage by weight of the superior 13Cr tool coupler is controlled to be: C 0.01-0.05%, Si≤0.5%, Mn 0.2-1.0%, Cr 12-14%, Mo 1-3%, Ni 4-6%, and a balance of Fe and inevitable impurities.

Furthermore, in step (2), the forging temperature is 1150-1200° C.

Furthermore, in step (4), the quenching temperature is 950-1000° C.

Furthermore, in step (4), the quenching is an oil quenching.

In an existing process for manufacturing a tool coupler, the quenching mostly takes place by an overall quenching with a water-based quenching liquid containing a certain concentration of a medium. A quenching with a water based quenching liquid requires the concentration of the medium to be adjusted. The inventor discovered after a lot of experiments and analyses that a too high concentration of the quenching liquid will lead to a poor quenching effect, and at a too low concentration of the quenching liquid, the effect of the medium will be lost, causing the occurrence of quenching cracks. At the same time, during continuous production, there is a loss of the quenching liquid, and it is required to monitor the concentration of the medium at any time, causing certain difficulties in stable production. Thus, an oil quenching is used for the quenching in the present technical solution. The properties of oil are very stable, without the need to adjust the concentration of the medium, and without producing quenching cracks due to a too high or too low concentration.

Furthermore, in step (5), the tempering temperature is 600-650° C.

In the method for manufacturing a superior 13Cr tool coupler described above, a step of rough machining the blank is further provided between step (3) and step (4).

By the method for manufacturing a superior 13Cr tool coupler according to the present invention, a high-quality superior 13Cr tool coupler can be produced, which can be adapted to a superior 13Cr tube body to form a superior 13Cr drillrod. There is no galvanic corrosion at the connection position between the superior 13Cr tool coupler manufactured by means of the present technical solution and the tube body, and thus there is no sever corrosion at the coupler. The superior 13Cr tool coupler manufactured by means of the present technical solution may have a mechanic feature of above 110 ksi.

DETAILED DESCRIPTION OF THE INVENTION

The method for manufacturing a superior 13Cr tool coupler according to the present invention is described below in more details, in conjunction with particular embodiments.

Embodiments 1-5

A superior 13Cr tool coupler is manufactured in the following steps:

(1) obtaining a blank, with the chemical composition thereof in percentage by weight being controlled to be: C 0.01-0.05%, Si≤0.5%, Mn 0.2-1.0%, Cr 12-14%, Mo 1-3%, Ni 4-6%, and a balance of Fe and inevitable impurities;

(2) forging the blank at 1150-1200° C.;

(3) heating the forged blank to 600-700° C. for a stress-relief annealing;

(4) rough machining the blank;

(5) after heating the rough machined blank to 950-1000° C., quenching and cooling same in an oil tank; and (6) tempering, with the tempering temperature being controlled at 600-650° C.

The composition formulations of the tool couplers in embodiments 1-5 of the present application are shown in table 1.

Table 1 (wt %, with a balance of Fe and other inevitable impurities)

TABLE 1

| Type of Steel | C | Si | Mn | Cr | Mo | Ni |
|---|---|---|---|---|---|---|
| Embodiment 1 | 0.04 | 0.27 | 0.92 | 13.9 | 1.8 | 5.8 |
| Embodiment 2 | 0.03 | 0.28 | 0.70 | 12.8 | 2.7 | 4.1 |
| Embodiment 3 | 0.02 | 0.34 | 0.40 | 12.3 | 1.1 | 4.9 |
| Embodiment 4 | 0.03 | 0.42 | 0.52 | 12.5 | 1.9 | 5.5 |
| Embodiment 5 | 0.04 | 0.25 | 0.65 | 13.7 | 2.5 | 4.5 |

Process parameters of the steps and mechanic performance of the tool couplers in embodiments 1-5 of the present application are listed in table 2.

TABLE 2

| Type of Steel | Heating temperature for forging, ° C. | Stress-relief annealing temperature, ° C. | Quenching temperature, ° C. | Tempering temperature, ° C. | Yield strength, MPa | Tensile strength, MPa |
|---|---|---|---|---|---|---|
| Embodiment 1 | 1160 | 680 | 960 | 640 | 835 | 928 |
| Embodiment 2 | 1180 | 650 | 970 | 630 | 851 | 939 |
| Embodiment 3 | 1190 | 620 | 980 | 620 | 883 | 965 |
| Embodiment 4 | 1175 | 660 | 975 | 610 | 915 | 1020 |
| Embodiment 5 | 1170 | 640 | 990 | 632 | 845 | 938 |

It can be seen from table 2 that the superior 13Cr tool coupler manufactured by the method according to the present technical solution can achieve a mechanic feature of above 110 ksi.

It should be noted that what are set forth above are only particular embodiments of the present invention, and that clearly the present invention is not to be limited to these embodiments, but covers many similar variations thereof. All of the variations either directly derived from or associated with the disclosure of the present invention by those skilled in the art will fall into the protective scope of the present invention.

The invention claimed is:

1. A method for manufacturing a 13Cr tool coupler, wherein the 13Cr tool coupler consists essentially of 0.01-0.05 wt % carbon, 0.25-0.42 wt % silicon, 0.2-1.0 wt % manganese, 12-14 wt % chromium, 1-3 wt % molybdenum, 4-6 wt % nickel, and a balance of iron and inevitable impurities, the method consisting of:

(1) manufacturing a blank;

(2) forging the blank and cooling the blank after forging;

(3) annealing the forged blank at 600-700° C. to relieve stress;

(4) rough machining the blank;

(5) heating the rough machined blank, and then quenching the same in an oil tank; and (6) tempering the quenched blank;

wherefrom the 13Cr tool coupler is manufactured, wherein the manufactured 13Cr tool coupler has a yield strength from 835 MPa to 915 MPa and a tensile strength from 928 MPa to 1020 MPa, and wherein the manufactured 13Cr tool coupler has a tempered martensitic structure.

2. The method of claim 1, wherein the manufactured blank is forged at a temperature ranging from 1150-1200° C.

3. The method of claim 1, wherein the rough machined blank is heated to a temperature ranging from 950-1000° C.

4. The method of claim 1, wherein the quenched blank is tempered at a temperature ranging from 600-650° C.

* * * * *